US007140062B1

(12) United States Patent
Chen

(10) Patent No.: US 7,140,062 B1
(45) Date of Patent: Nov. 28, 2006

(54) BRUSH STRUCTURE FOR VACUUM CLEANER

(76) Inventor: Fu Yu Chen, No.1, Alley 16, Lane 40, Jinn Te Rd., Taichung (TW)

( * ) Notice: Subject to any disclaimer, the term of this patent is extended or adjusted under 35 U.S.C. 154(b) by 274 days.

(21) Appl. No.: 10/694,319

(22) Filed: Oct. 23, 2003

(51) Int. Cl.
*A46B 13/02* (2006.01)
*A46B 7/00* (2006.01)

(52) U.S. Cl. ..... 15/182; 15/179

(58) Field of Classification Search ..... 15/179, 15/182
See application file for complete search history.

(56) References Cited

U.S. PATENT DOCUMENTS 3,241,172 A * 3/1966 Tilgner ..... 15/183
4,177,536 A * 12/1979 Powers ..... 15/182
5,819,357 A * 10/1998 Gould ..... 15/182

* cited by examiner

*Primary Examiner*—Randall Chin

(57) ABSTRACT

A brush structure includes a rotation bar, a plurality of brush strips, a plurality of fixing blocks, and a driving block mounted on the rotation bar to rotate the rotation bar. Thus, the helical groove is extended through the whole length of each of the two arc-shaped plates of the rotation bar, so that each of the two brush strips is extended through the whole length of each of the two arc-shaped plates of the rotation bar without interruption, thereby enhancing the cleaning effect of each of the two brush strips.

2 Claims, 13 Drawing Sheets

BRUSH STRUCTURE FOR VACUUM CLEANER

BACKGROUND OF THE INVENTION

1. Field of the Invention

The present invention relates to a brush structure, and more particularly to a brush structure for a vacuum cleaner.

2. Description of the Related Art

A conventional brush structure for a vacuum cleaner in accordance with the prior art shown in FIGS. 7 and 8 comprises a tube 50 having two ends each formed with two symmetrical grooves 52, four brush strips 60 each mounted in a respective one of the grooves 52 of the tube 50 and each having a surface provided with a plurality of bristles 61, and two support blocks 70 mounted in the two ends of the tube 50 to prevent deformation of the tube 50. The grooves 52 of the tube 50 are separated from each other by a separation zone 51. Each of the brush strips 60 has two sides each formed with an insertion groove 62 (see FIG. 7A) for insertion of a side of the respective groove 52 of the tube 50 as shown in FIG. 8A.

However, the brush strips 60 are separated by the separation zone 51, thereby decreasing the cleaning effect of the brush strips 60. In addition, the conventional brush structure needs to provide four brush strips, thereby increasing costs of fabrication and assembly.

SUMMARY OF THE INVENTION

The present invention is to mitigate and/or obviate the disadvantage of the conventional brush structure for a vacuum cleaner.

The primary objective of the present invention is to provide a brush structure for a vacuum cleaner.

Another objective of the present invention is to provide a brush structure, wherein the helical groove is extended through the whole length of each of the two arc-shaped plates of the rotation bar, so that each of the two brush strips is extended through the whole length of each of the two arc-shaped plates of the rotation bar without interruption, thereby enhancing the cleaning effect of each of the two brush strips.

A further objective of the present invention is to provide a brush structure that only needs to provide two brush strips, thereby decreasing costs of consumption.

A further objective of the present invention is to provide a brush structure, wherein the rotation bar has a tubular shape, thereby decreasing the whole weight of the brush structure.

In accordance with the present invention, there is provided a brush structure, comprising:

a rotation bar including a plurality of arc-shaped plates combined with each other, each of the arc-shaped plates of the rotation bar having two sides each formed with a helical rim, so that a plurality of helical grooves are formed between the helical rims of the arc-shaped plates of the rotation bar;

a plurality of brush strips each mounted in a respective one of the helical groove of the rotation bar;

a plurality of fixing blocks each mounted in the rotation bar between the arc-shaped plates; and a driving block mounted on the rotation bar to rotate the rotation bar.

Further benefits and advantages of the present invention will become apparent after a careful reading of the detailed description with appropriate reference to the accompanying drawings.

DETAILED DESCRIPTION OF THE INVENTION

Figure 1:
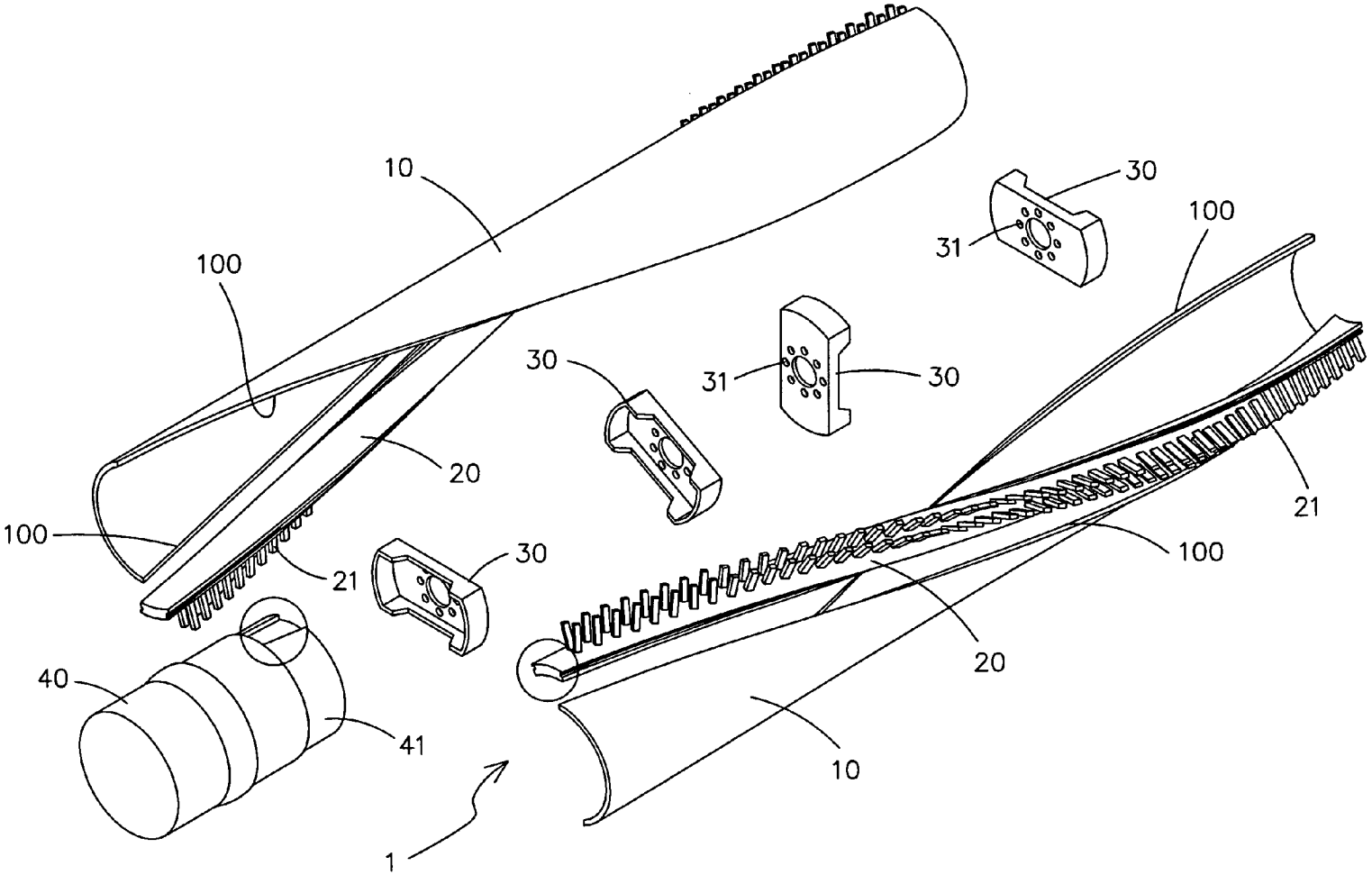
FIG. 1 is an exploded perspective view of a brush structure in accordance with the preferred embodiment of the present invention.

Referring to the drawings and initially to FIGS. 1–4, a brush structure in accordance with the preferred embodiment of the present invention is mounted on the air inlet of a vacuum cleaner, and can be rotated during the dusting process to brush and clear the face to be cleaned.

The brush structure comprises a rotation bar 1, two brush strips 20, a plurality of fixing blocks 30, and a driving block 40.

The rotation bar 1 has a tubular shape and includes two opposite arc-shaped plates 10 combined with each other. Each of the two arc-shaped plates 10 of the rotation bar 1 has two sides each formed with a helical rim 100, so that a helical groove 11 is formed between the helical rims 100 of the two arc-shaped plates 10 of the rotation bar 1. Thus, the rotation bar 1 is formed with two helical grooves 11. In addition, the helical groove 11 is extended through a whole length of each of the two arc-shaped plates 10 of the rotation bar 1.

Figure 1A:
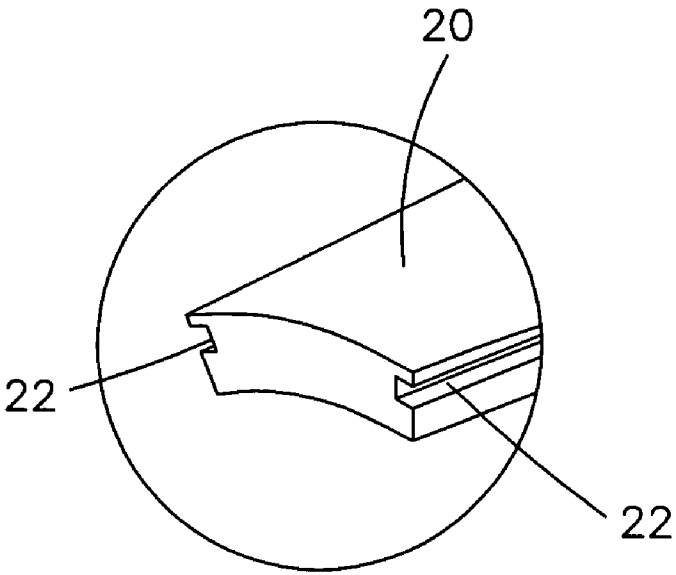
FIG. 1A is a partially enlarged view of the brush structure as shown in FIG. 1.
Figure 3:
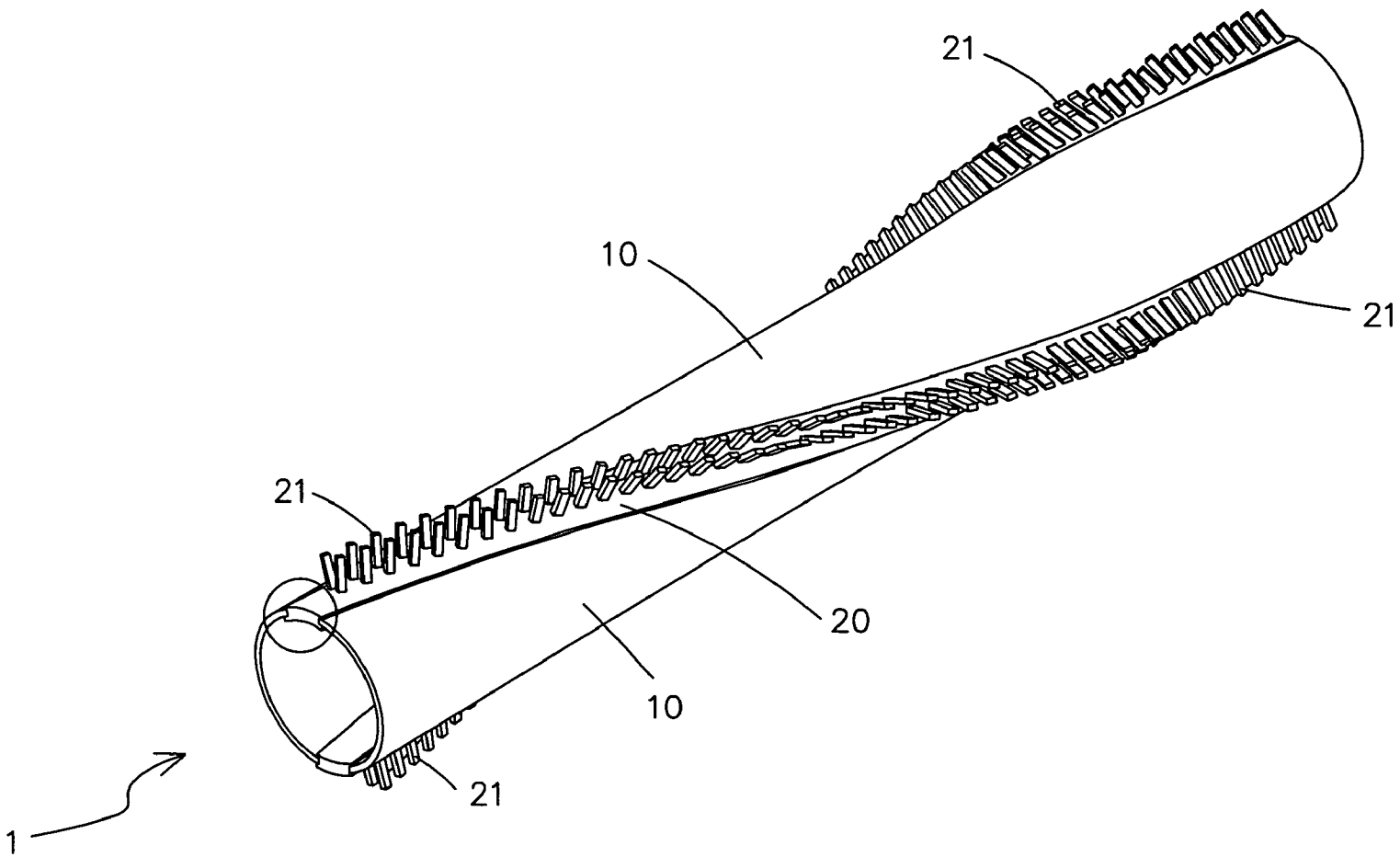
FIG. 3 is a partially perspective assembly view of the brush structure as shown in FIG. 1.
Figure 3A:
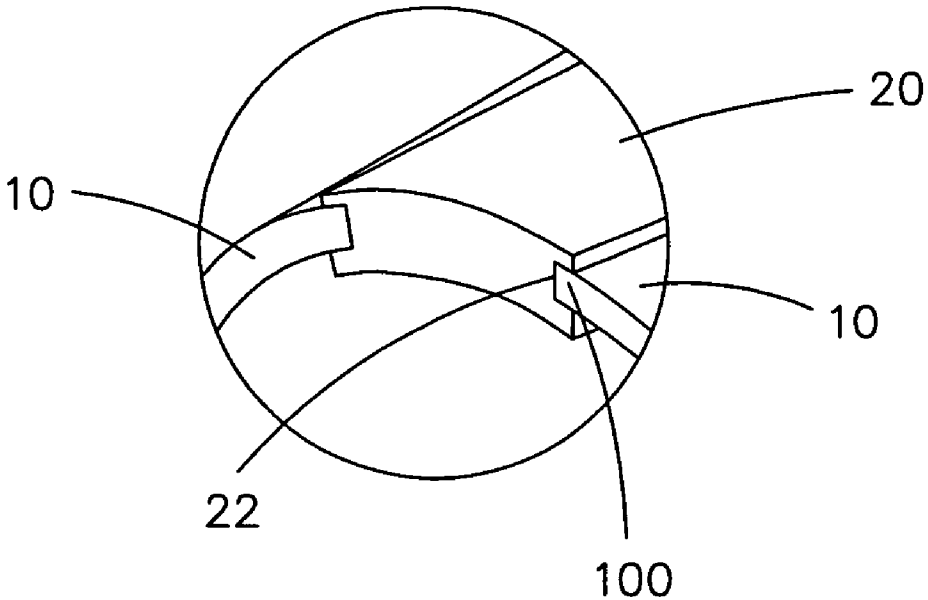
FIG. 3A is a partially enlarged view of the brush structure as shown in FIG. 3.
Figure 4:
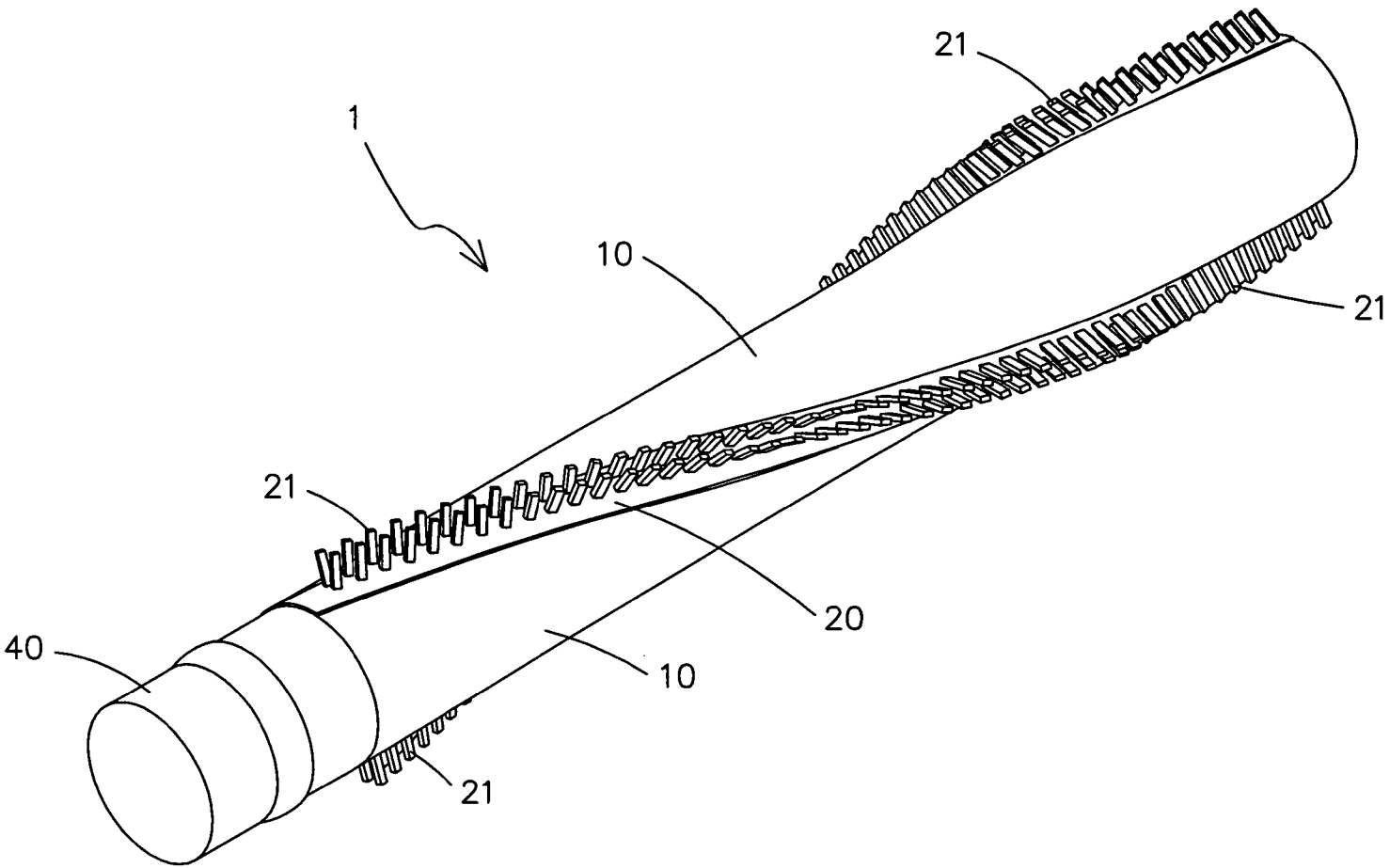
FIG. 4 is a perspective assembly view of the brush structure as shown in FIG. 1.

Each of the two brush strips 20 has a helical shape and is mounted in the respective helical groove 11 of the rotation bar 1. Each of the two brush strips 20 has two sides each formed with an insertion groove 22 (see FIG. 1A) for insertion of the respective helical rim 100 of each of the two arc-shaped plates 10 of the rotation bar 1 as shown in FIG. 3A. Each of the two brush strips 20 has a surface provided with a plurality of bristles 21. In addition, each of the two brush strips 20 is extended through a whole length of each of the two arc-shaped plates 10 of the rotation bar 1.

Each of the fixing blocks 30 is mounted in the rotation bar 1 between the two arc-shaped plates 10. Each of the fixing blocks 30 has two sides each fixed on the respective arc-shaped plate 10 of the rotation bar 1 in a spot soldering manner, so that the two arc-shaped plates 10 of the rotation bar 1 are combined to form the tubular shaped rotation bar 1. Each of the fixing blocks 30 is formed with a plurality of through holes 31 for mounting a washer (not shown) so as to balance the center of gravity of the rotation bar 1, thereby preventing the rotation bar 1 from producing vibration during rotation.

Figure 1B:
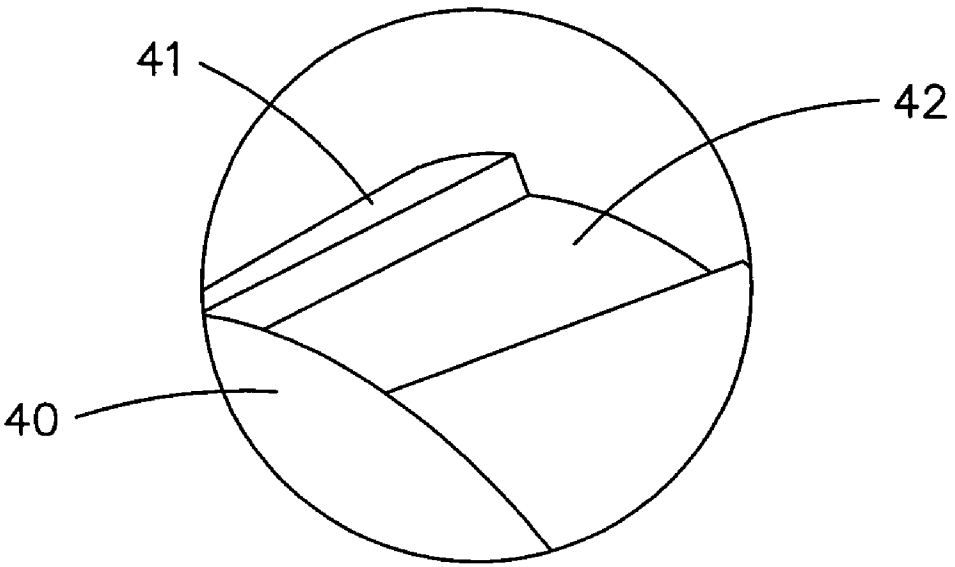
FIG. 1B is a partially enlarged view of the brush structure as shown in FIG. 1.
Figure 2:
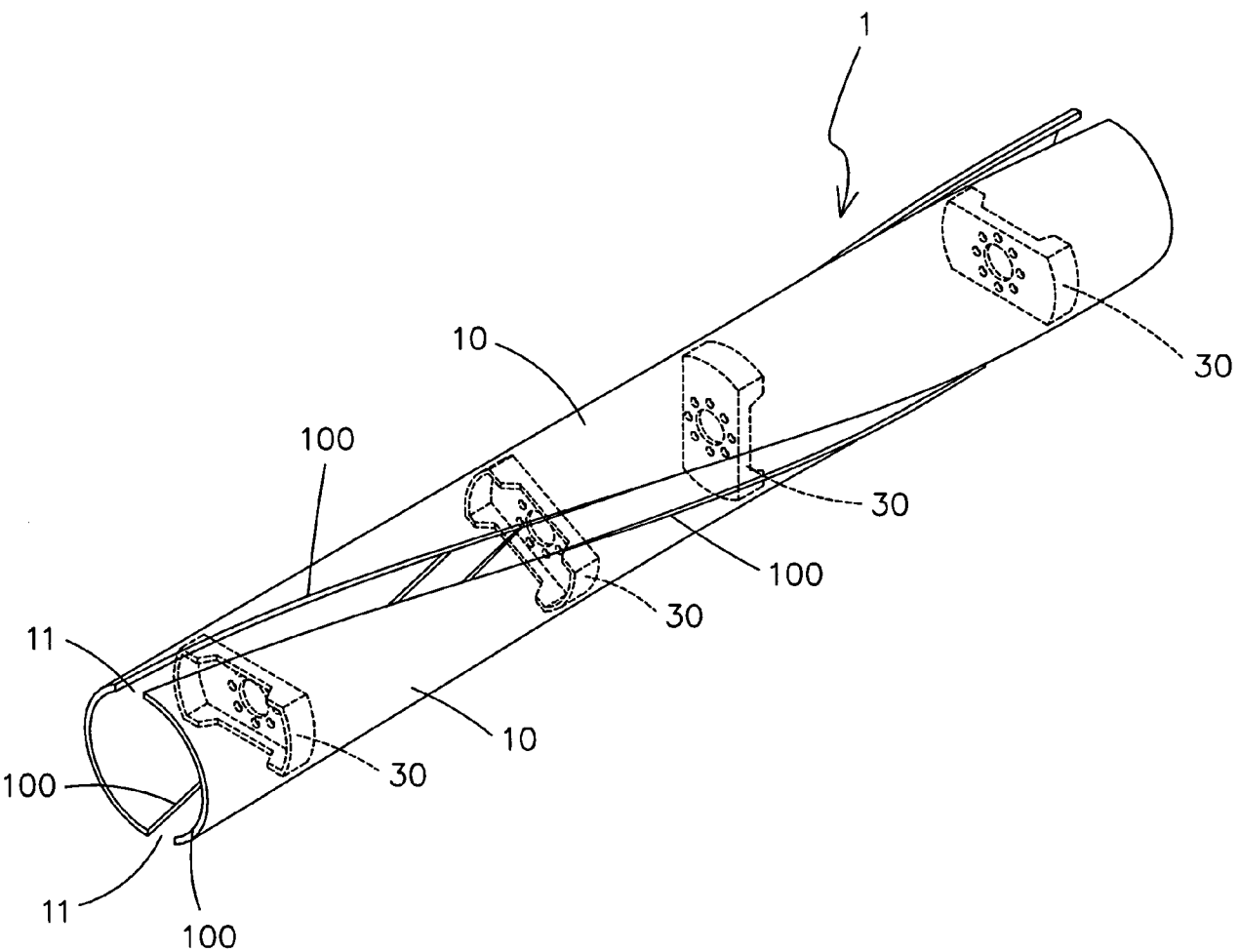
FIG. 2 is a partially perspective assembly view of the brush structure as shown in FIG. 1.

The driving block 40 is mounted on the rotation bar 1 and driven by a belt (not shown), so that the driving block 40 is driven by the belt to rotate the rotation bar 1. The driving block 40 has an end formed with a mounting portion 41 mounted in an end of the rotation bar 1, so that the driving block 40 is secured on the rotation bar 1. The mounting portion 41 of the driving block 40 has a periphery formed with two radially opposite recesses 42 (see FIG. 1B), and each of the two brush strips 20 has an end inserted into the respective recess 42 of the mounting portion 41 of the driving block 40.

Accordingly, the helical groove 11 is extended through the whole length of each of the two arc-shaped plates 10 of the rotation bar 1, so that each of the two brush strips 20 is extended through the whole length of each of the two arc-shaped plates 10 of the rotation bar 1 without interruption, thereby enhancing the cleaning effect of each of the two brush strips 20. In addition, the brush structure only needs to provide two brush strips 20, thereby greatly decreasing costs of consumption. Further, The rotation bar 1 has a tubular shape, thereby decreasing the whole weight of the brush structure.

Figure 5:
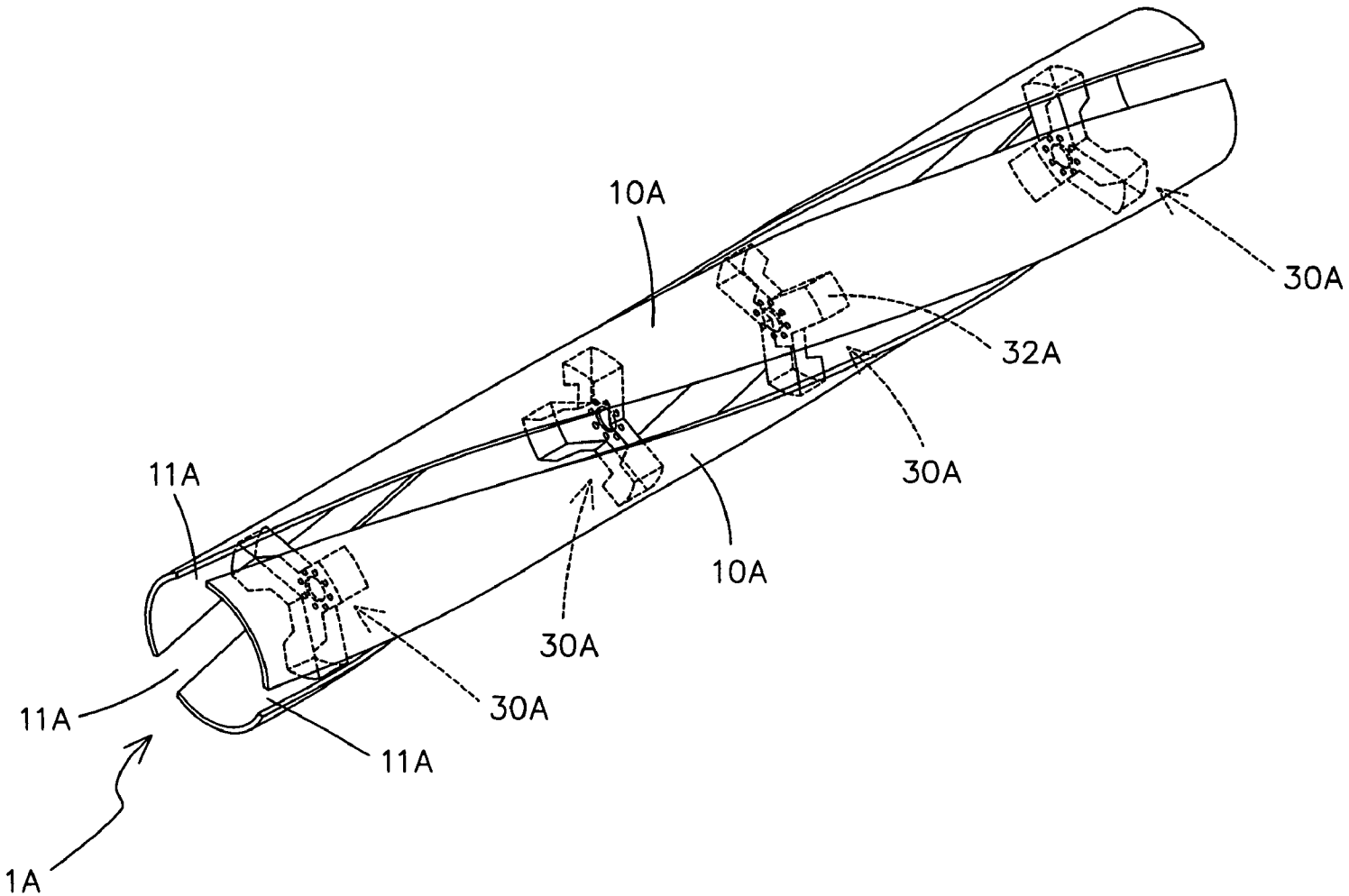
FIG. 5 is a partially perspective assembly view of a brush structure in accordance with another embodiment of the present invention.
Figure 6:
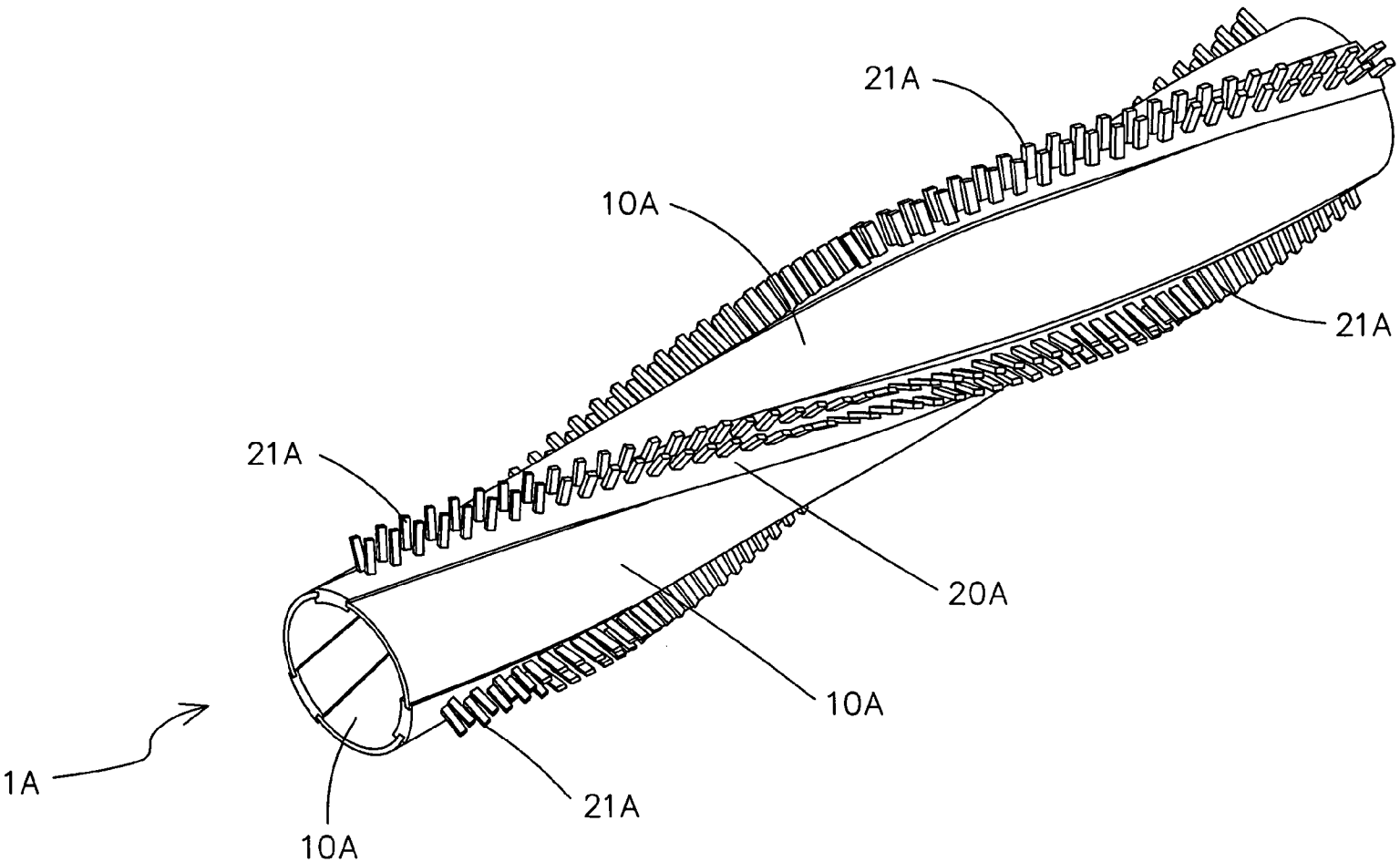
FIG. 6 is a perspective assembly view of the brush structure in accordance with another embodiment of the present invention.
Figure 7:
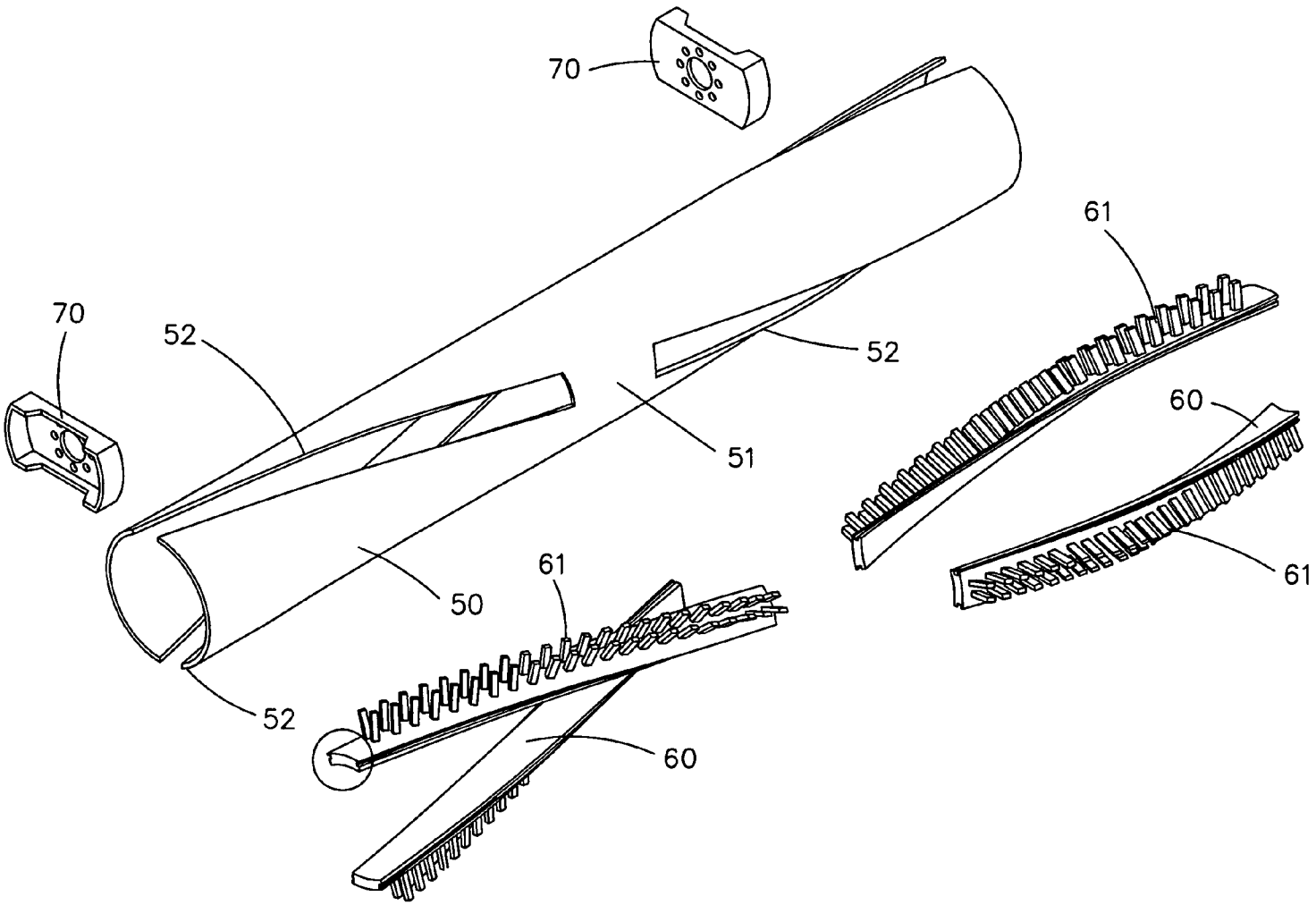
FIG.7 PRIOR ART
FIG. 7 is an exploded perspective view of a conventional brush structure in accordance with the prior art.
Figure 7A:
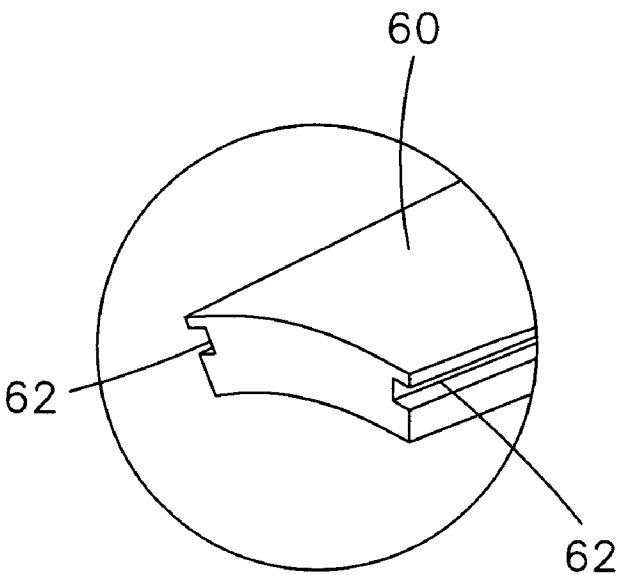
FIG.7A PRIOR ART
FIG. 7A is a partially enlarged view of the conventional brush structure as shown in FIG. 7.
Figure 8:
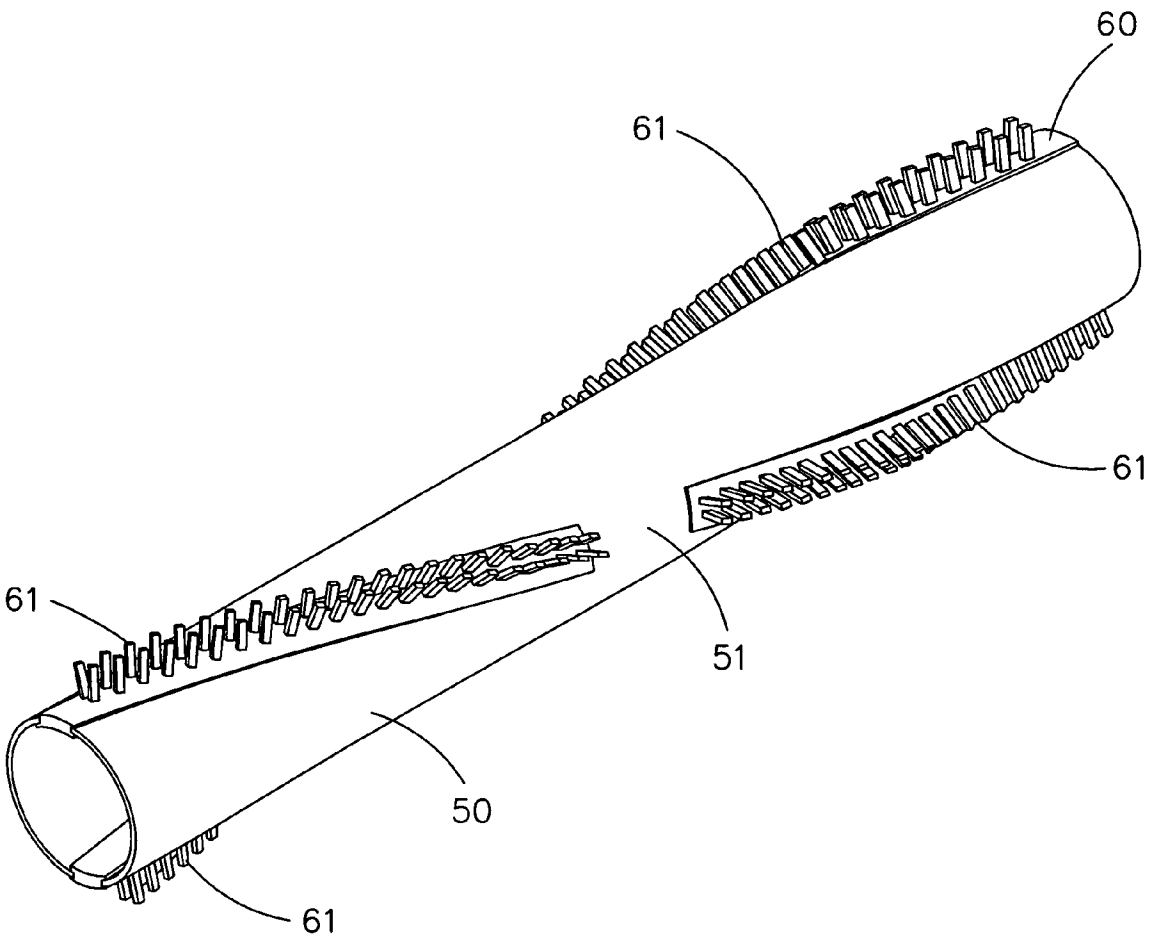
FIG.8 PRIOR ART
FIG. 8 is a perspective assembly view of the conventional brush structure as shown in FIG. 7.
Figure 8A:
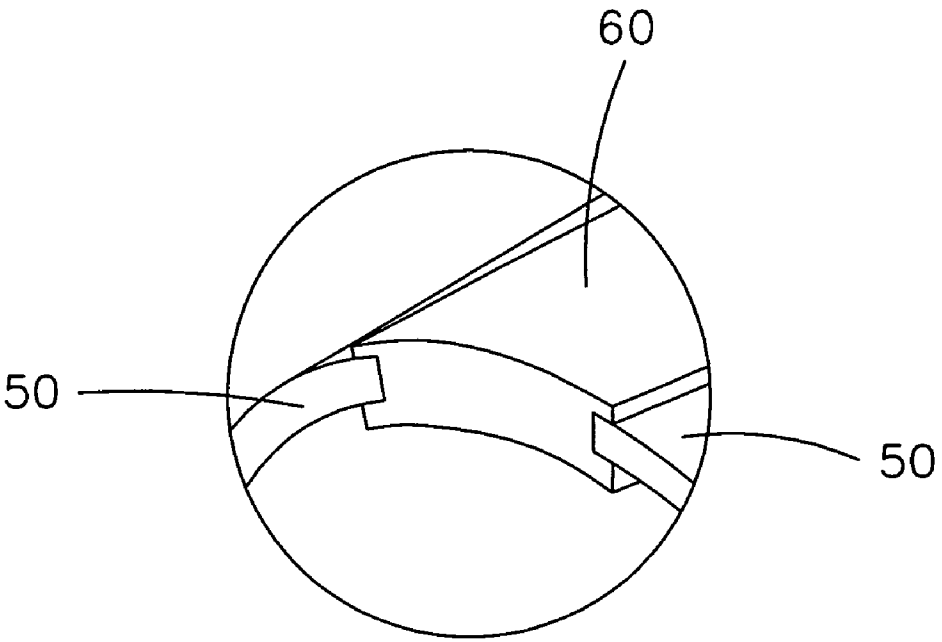
FIG.8A PRIOR ART
FIG. 8A is a partially enlarged view of the conventional brush structure as shown in FIG. 8.

Referring to FIGS. 5 and 6, a brush structure in accordance with another embodiment of the present invention is shown, wherein the rotation bar 1A includes three arc-shaped plates 10A combined with each other, so that the rotation bar 1A is formed with three helical grooves 11A for mounting three brush strips 20A each having a surface provided with a plurality of bristles 21A. Thus, the rotation bar 1A is provided with three brush strips 20A arranged in a helical manner. In addition, each of the fixing blocks 30A has three lugs 32A for fixing the three arc-shaped plates 10A.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A brush structure, comprising:

a rotation bar comprising a plurality of arc-shaped plates combined with each other, each of the arc-shaped plates comprising two sides each formed with a helical rim, so that a plurality of helical grooves are defined between the helical rims;

a plurality of brush strips each installed in a related one of the helical grooves of the rotation bar and formed with two sides each defining a groove for receiving the related helical rim of each of the arc-shaped plates of the rotation bar;

a plurality of fixing blocks each installed in the rotation bar between the arc-shaped plates; and a driving block mounted on the rotation bar in order to rotate the rotation bar.

2. A brush structure, comprising:

a rotation bar comprising a plurality of arc-shaped plates combined with each other, each of the arc-shaped plates comprising two sides each formed with a helical rim, so that a plurality of helical grooves are defined between the helical rims;

a plurality of brush strips each installed in a related one of the helical grooves of the rotation bar;

a plurality of fixing blocks each installed in the rotation bar between the arc-shaped plates; and a driving block mounted on the rotation bar in order to rotate the rotation bar and formed with a periphery defining a plurality of recesses each for receiving an end of a related one of the brush strips.

* * * * *